US006290782B1

(12) United States Patent
Sakurada et al.

(10) Patent No.: US 6,290,782 B1
(45) Date of Patent: Sep. 18, 2001

(54) MAGNETIC MATERIAL AND MANUFACTURING METHOD THEREOF, AND BONDED MAGNET USING THE SAME

(75) Inventors: Shinya Sakurada, Tokyo; Tomohisa Arai, Yokohama; Masami Okamura, Yokohama; Keisuke Hashimoto, Yokohama; Takahiro Hirai, Kamakura, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/276,736

(22) Filed: Mar. 26, 1999

(30) Foreign Application Priority Data

Mar. 27, 1998 (JP) ..... P10-081726

(51) Int. Cl.[7] ..... H01F 1/057
(52) U.S. Cl. ..... 148/302; 252/62.55
(58) Field of Search ..... 148/301, 302, 148/303; 252/62.54, 62.55

(56) References Cited

U.S. PATENT DOCUMENTS

| | | | | |
|---|---|---|---|---|
| 4,981,532 | | 1/1991 | Takeshita et al. | 148/302 |
| 5,110,374 | | 5/1992 | Takeshita et al. | 148/101 |
| 5,480,495 | * | 1/1996 | Sakurada et al. | 148/301 |
| 5,549,766 | * | 8/1996 | Tsutai et al. | 148/301 |
| 5,658,396 | * | 8/1997 | Sakurada et al. | 148/301 |
| 5,716,462 | * | 2/1998 | Sakurada et al. | 148/302 |
| 5,750,044 | * | 5/1998 | Yoneyama et al. | 252/62.54 |

FOREIGN PATENT DOCUMENTS

| | | |
|---|---|---|
| 1-132106 | 5/1989 | (JP) . |
| 4-260302 | 4/1992 | (JP) . |
| 5-82041 | 11/1993 | (JP) . |
| 8-37122 | 2/1996 | (JP) . |
| 8-91006 | 7/1996 | (JP) . |

OTHER PUBLICATIONS

Nakamura et al., High–coercivity $Sm_2Fe_{17}N_x$ powders produced by HDDR and nitriding processes, *Material chemistry and Physics,* 32 (1992), pp 280–285.

* cited by examiner

*Primary Examiner*—John P Sheehan
(74) *Attorney, Agent, or Firm*—Foley & Lardner

(57) ABSTRACT

A magnetic material has a composition expressed by the following general formula, general formula: $\{(R^1{}_XR^2{}_{1-X})_YB_ZT_{1-Y-Z}\}_{1-Q}N_Q$ (where, $R^1$ is at least one kind of element selected from rare earth elements, $R^2$ is at least one kind of element selected from Zr, Hf, Ti and Sc, T is at least one kind of element selected from Fe and Co, and X, Y, Z and Q designate numerical values satisfying $0.5 \leqq X < 1$, $0.05 \leqq Y \leqq 0.2$, $0 \leqq Z \leqq 0.1$ and $0.1 \leqq Q \leqq 0.2$), and includes 5 volume % or more of a $Th_2Ni_{17}$ crystal phase. The magnetic material has a recrystallization texture of which average grain diameter is in the range of from 0.02 to 50 $\mu$m, and is excellent in magnetic property. Such a magnetic material is obtained by giving a HDDR treatment to a mother alloy of which principal phase is a $Th_2Ni_{17}$ crystal phase.

13 Claims, No Drawings

MAGNETIC MATERIAL AND MANUFACTURING METHOD THEREOF, AND BONDED MAGNET USING THE SAME

BACKGROUND OF THE INVENTION

1. Field of the Invention

The present invention relates to a magnetic material that is employed as a high performance permanent magnet and a manufacturing method of the same, and a bonded magnet using the same.

2. Description of the Related Art

So far, as a kind of a high performance permanent magnet, a rare earth magnet such as a Sm—Co system magnet, a Nd—Fe—B system magnet or the like is known. In these magnets, a large amount of Fe and/or Co is included and contributes to an increase of saturation magnetization. In addition, rare earth elements such as Nd and Sm, due to the behavior of 4f electrons in a crystal field, renders a very large magnetocrystalline anisotropy. Thereby, an increase of coercive force is obtained.

Such a rare earth system high performance magnet is mainly used for electrical appliances such as a speaker, a motor, a measurement instrument or the like. Recently, demand for smaller size of various kinds of electrical appliances is high. Accordingly, a high performance permanent magnet is demanded to cope with this demand. For these demands, a Fe—R—N system magnet (R is one element selected from Y, Th and Lanthanoid elements)(cf. Japanese Patent Application KOKOKU Publication No. Hei 5-082041 and so on) is proposed. However, it does not necessarily have sufficient characteristics.

Further, Japanese Patent Application KOKAI Publication No. Hei 8-191006 discloses a R—Zr—Fe (Co)—N system magnetic material (R: rare earth element) in which a phase having a $Th_2Ni_{17}$ crystal structure (hereinafter refers to as $Th_2Ni_{17}$ crystal phase) is a principal phase. The $Th_2Ni_{17}$ crystal phase, compared with a phase having a $Th_2Zn_{17}$ crystal structure ($Th_2Zn_{17}$ type crystal phase) can include a larger amount of Fe and/or Co. Accordingly, a magnetic material having the $Th_2Ni_{17}$ crystal phase as its principal phase is expected as a promising forming material of a permanent magnet in which the saturation magnetization or the like is further improved.

However, the magnetic material, of which principal phase is the $Th_2Ni_{17}$ crystal phase, obtained by the conventional manufacturing method has a disadvantage that its grain is relatively coarse. As a method for making fine grain, as disclosed in Japanese Patent Application KOKAI Publication No. Hei 8-191006, there are a rapid quenching method and a mechanical alloying method. However, these methods are disadvantageous from standpoints of improvement of manufacturing efficiency and reduction of manufacturing cost.

On the other hand, in the R—Fe—B system magnetic material, as a means for obtaining a fine grain, a HDDR (Hydrogenation-Disproportionation-Desorption-Recombination) method is known (cf. Japanese Patent Application KOKAI Publication No. Hei 1-132106). The HDDR method will be described in the following. In the case of the R—Fe—B system magnetic material, for instance, first, a R—Fe—B system mother alloy of which principal phase is $R_2Fe_{14}B$ phase is heat treated in an atmosphere of hydrogen to transform into respective phases of $RH_X$, $Fe_2B$, and Fe. Then, in a dehydrogenation process, $H_2$is removed from the material to form again the $R_2Fe_{14}B$ phase. Thus obtained alloy has a recrystallization texture of which principal phase is a fine $R_2Fe_{14}B$ phase of an average grain diameter of approximately 0.05 to 3 $\mu$m. Thus, the HDDR method enables to obtain a fine texture only by an atmosphere treatment in an electric furnace, accordingly, from the standpoint of the manufacturing cost, is advantageous.

There are several reports in which the HDDR method is applied in magnetic material other than the R—Fe—B system. Mat.Chem.Phys.32, 280 to 285 (1992), for instance, discloses a $Sm_2Fe_{17}N_x$ system magnetic material of which principal phase is the $Th_2Zn_{17}$ crystal phase and which is prepared by use of the HDDR method.

Further, Japanese Patent Application KOKAI Publication No. Hei 8-037122 discloses a manufacturing method of a magnetic material where, a R—M—T system alloy (R: rare earth element, M: metallic element such as Al, Ti, V, Cr or the like, T: Fe, Fe—Co) of which principal phase is the $Th_2Zn_{17}$ crystal phase is first HDDR treated, thereafter, nitrogenized to prepare a R—M—T—N system magnetic material of which principal phase is the $Th_2Zn_{17}$ crystal phase or a $TbCu_7$ crystal phase. Further, in Japanese Patent Application KOKAI Publication No. Hei 4-260302, an alloy having a crystal structure of $R_2(T,M)L_{17}$ system (R: rare earth element, T: Fe or Fe—Co, M: metallic element such as Zr, Hf, Nb, Ta or the like) is exposed to the HDDR treatment.

All the HDDR treatments disclosed in these Patent Publications are given to the alloys of which principal phases are the $Th_2Zn_{17}$ crystal phase. Further, in Japanese Patent Application KOKAI Publication No. Hei 8-037122, an anisotropic magnetic material is obtained. Incidentally, in Japanese Patent Application KOKAI Publication No. Hei 4-260302, in order to invest an anisotropy to a magnetic material, the M element is added, and the crystal structure of the magnetic material is described as the $R_2(T,M)_{17}$ type. In the absence of the M, the crystal structure is the $Th_2Zn_{17}$ type, also in the presence of the M, similarly the crystal structure is considered to be the $Th_2Zn_{17}$ type.

Thus, though the HDDR method is known as a technique for making fine grain of the magnetic material, there is no disclosure in which the HDDR method is applied to the magnetic material that contains the $Th_2Ni_{17}$ type crystal phase as an indispensable component.

SUMMARY OF THE INVENTION

Therefore, an object of the present invention is to provide a magnetic material that is, by making fine grain of a magnetic material having the $Th_2Ni_{17}$ type crystal phase as an indispensable component, enhanced in magnetic characteristics, and a manufacturing method thereof. Further, another object is to provide a high performance bonded magnet that employs such a magnetic material.

The present inventors have eagerly studied to accomplish the aforementioned objects. As a result of this, the inventors found that even to a mother alloy having the $Th_2Ni_{17}$ type crystal phase (a phase having the $Th_2Ni_{17}$ type crystal structure) as a principal phase, the HDDR method is effective. By giving the HDDR treatment to a mother alloy having the $Th_2Ni_{17}$ type crystal phase as a principal phase, a magnetic material that includes the $Th_2Ni_{17}$ type crystal phase as an indispensable component and has a fine recrystallization texture can be obtained.

The present invention was accomplished based on this finding. A magnetic material of the present invention is characterized in that it has a composition expressed by the following general formula, $$\text{general formula: } \{(R^1{}_XR^2{}_{1-X})_YB_{ZT1-Y-z}\}_{1-Q}N_Q$$

(where, $R^1$ is at least one kind of element selected from rare earth elements, $R^2$ is at least one kind of element selected from Zr, Hf, Ti and Sc, T is at least one kind of element selected from Fe and Co, and X, Y, Z and Q denote numerical values satisfying $0.5 \leqq X<1$, $0.05 \leqq Y \leqq 0.2$, $0 \leqq Z \leqq 0.1$ and $0.1 \leqq Q \leqq 0.2$), and includes 5 volume % or more of the $Th_2Ni_{17}$ type crystal phase, and the average grain diameter of the magnetic material is in the range of from 0.02 to 50 $\mu$m.

The magnetic material of the present invention has a recrystallization texture due to absorption and desorption of hydrogen. More specific, the magnetic material of the present invention has a recrystallization texture obtained through recrystallization due to the absorption and desorption of hydrogen by a mother alloy having the $Th_2Ni_{17}$ type crystal phase as a principal phase. The magnetic material of the present invention is particularly preferable to have the $Th_2Ni_{17}$ type crystal phase as a principal phase, however, depending on the manufacturing conditions, a magnetic material of which the principal phase is the $Th_2Zn_{17}$ type crystal phase or the $TbCu_7$ type crystal phase can be obtained. The magnetic material of the present invention is preferable to further include a small quantity of boron. The content of boron is preferable to be in the range of $0<Z \leqq 0.1$ as the value of Z.

A manufacturing method of a magnetic material of the present invention comprises steps of preparing a mother alloy having the $Th_2Ni_{17}$ type crystal phase as a principal phase, of recrystallizing, by letting the mother alloy absorb and desorb hydrogen, the mother alloy, and of preparing, by letting the recrystallized mother alloy absorb nitrogen, a magnetic material.

In the manufacturing method of the magnetic material of the present invention, a mother alloy is preferable to have a composition expressed by the following general formula, $$\text{general formula: } (R^1{}_XR^2{}_{1-X})_YB_ZT_{1-Y-Z}$$

(where, $R^1$ is at least one kind of element selected from rare earth elements, $R^2$ is at least one kind of element selected from Zr, Hf and Sc, T is at least one kind of element selected from Fe and Co, and X, Y, and Z denote numerical values satisfying $0.5 \leqq X<1$, $0.05 \leqq Y<0.2$, and $0 \leqq Z \leqq 0.1$).

A bonded magnet of the present invention comprises a mixture of the aforementioned magnetic material of the present invention and a binder, and is characterized in that the mixture has a formed body of a magnet shape.

This invention is disclosed in Japanese Patent Application No. 10-081726 filed on Mar. 27, 1998, and the entire disclosure thereof is incorporated herein by reference.

DESCRIPTION OF THE PREFERRED EMBODIMENTS

In the following, embodiments for carrying out the present invention will be described.

A magnetic material of the present invention has a composition expressed by the following general formula, $$\text{general formula: } \{(R^1{}_XR^2{}_{1-X})_YB_ZT_{1-Y-}\}_{1-Q}N_Q \quad (1)$$

(where, $R^1$ is at least one kind of element selected from rare earth elements, $R^2$ is at least one kind of element selected from Zr, Hf, Ti and Sc, T is at least one kind of element selected from Fe and Co, and X, Y, Z and Q denote numerical values satisfying $0.5 \leqq X<1$, $0.05 \leqq Y \leqq 0.2$, $0 \leqq Z \leqq 0.1$ and $0.1 \leqq Q \leqq 0.2$), and includes 5 volume % or more of a $Th_2Ni_{17}$ type crystal phase (a phase having the $Th_2Ni_{17}$ type crystal structure), and the average grain diameter of the magnetic material is in the range of from 0.02 to 50 $\mu$m.

First, the reasons for compounding the respective components constituting the magnetic material of the present invention and for defining compounding amount will be described.

Rare earth elements as the $R^1$ element are components that give a great magnetic anisotropy, accordingly a high coercive force, to a magnetic material. As such the $R^1$ element, La, Ce, Pr, Nd, Sm, Eu, Gd, Tb, Dy, Ho, Er, Tm, Lu, Y or the like can be cited. Among them, it is preferable in particular for Sm to be 50 atomic % or more of the $R^1$ element. Thereby, the magnetic anisotropy of the principal phase is enhanced to increase the coercive force thereof.

The $R^2$ element is at least one kind of element selected from Zr, Hf, Ti and Sc. Such the $R^2$ element has advantages such as reducing an average atomic radius of the rare earth sites by occupying the rare earth sites of the principal phase. Thus, the $R^2$ element plays an important role for obtaining the $Th_2Ni_{17}$ type crystal structure.

Ordinarily, it is known that in a binary alloy between R—T (T is Fe or Co), in the case of employing Ce, Pr, Nd, Sm, and Gd as the R element, the $Th_2Zn_{17}$ type crystal phase is obtained, and in the case of employing Tb, Dy, Ho, Er, Eu, Tm, Yb, Lu, and Y as the R element, the $Th_2Ni_{17}$ type crystal phase is obtained. By compounding $R^2$ element to such a system, even when Sm or Nd is employed as the R element ($R^2$ element), the $Th_2Ni_{17}$ type crystal phase is obtained. Further, the $R^2$ element suppresses precipitation of $\alpha$-Fe phase in the manufacturing process of the magnetic material to result in enhancement of the magnetic property.

In t he aforementioned for mula (1), the total amount of the $R^1$ element and $R^2$ element Y is designated in the range of $0.05 \leqq Y \leqq 0.2$. This is because by increasing the total amount Y of the $R^1$ element and the $R^2$ element, the large magnetic anisotropy is obtained to result in giving a high coercive force. However, when the $R^1$ element and the $R^2$ element are compounded too much, a magnetization is deteriorated. Therefore, t he value of Y is preferable to be in the range of $0.09 \leqq Y \leqq 0.15$.

In addition, the increase of the ratio X of the $R^1$ element to the total amount of the $R^1$ element and the $R^2$ element is advantageous for obtaining the high coercive force. Therefore, the value of X is designated in the range of $0.5 \leqq X<1$. However, when the ratio of the $R^1$ element is too large, the $Th_2Ni_{17}$ type crystal phase is difficult to obtain. In the case of obtaining a magnetic material of which principal phase is the $Th_2Ni_{17}$ type crystal phase, the value of X is preferable to be in the rang e of $0.5 \leqq X \leqq 0.85$. The value of X is more preferable to be in the range of $0.65 \leqq X \leqq 0.85$.

The T element is at least one kind of element selected from Fe and Co, and plays a role of increasing a saturation magnetization of the magnetic material. The increase of the saturation magnetization leads to an increase of a residual magnetization, and accompanying it, the maximum magnetic energy product also increases. Such the T element is preferable to be included 70 atomic % or more in the magnetic material, thereby the saturation magnetization can be effectively increased. Further, in further increasing the saturation magnetization of the magnetic material, 50 atomic % or more of the T element is preferable to be Fe.

A part of the T element may be replaced by at least one kind of element (M element) selected from V, Cr, Mo, W, Mn, Ga, Al, Sn, Ta, Nb, Si and Ni. By replacing a part of the T element with the M element, the magnetic property can be improved, and together with this, various practically important characteristics such as corrosion resistance, heat resistance or the like can be improved. However, when too much of the T element is replaced by the M element, since the deterioration of the magnetic characteristics becomes remarkable on the contrary, the replacement amount of the T element by the M element is preferable to be designated 20 atomic % or less.

In the magnetic material of the present invention, B (boron) is not necessarily required to be compounded. However, by compounding B, the treatment condition when the HDDR treatment that will be described later is implemented can be made loose, and the alloy texture (recrystallization texture) can be made more homogeneous and fine. Further, B shows an effect of suppressing the precipitation of an α-Fe phase or the like. Thereby, the residual magnetization and the maximum energy product of the magnetic material can be enhanced.

From the above description, the content of B is preferable to be in the range of $0<Z \leqq 0.1$ as the value of Z in the formula (1). When the value of Z that denotes the content of B exceeds 0.1, in the heat treatment step, the amount of formation of $R_2Fe_{14}B$ phase or the like increases to result in the deterioration of the magnetic property. The value of Z is more preferable to be 0.05 or less. Further, for the compounding of B to be more effective, the value of Z is further more preferable to be 0.005 or more.

N (nitrogen) mainly exists in the interstitial sites of the principal phase, and plays a role of, when compared with the absence of N, improving the Curie temperature and magnetocrystalline anisotropy of the principal phase. Among them, the improvement of the magnetocrystalline anisotropy is important in giving a large coercive force to the magnetic material. Though the N exhibits its effect with a small quantity, if too much of it is included, an amorphous phase or an α-Fe phase tends to form, resulting in a deterioration of the magnetic characteristics of the magnetic material. Accordingly, the value of Q that shows the content of the N is designated in the range of $0.1 \leqq Q \leqq 0.2$. The value of Q is more preferable to be in the range of $0.14 \leqq Q \leqq 0.18$.

A part of the N may be replaced by hydrogen (H). In some cases, the H is introduced into the magnetic material by the heat treatment based on the HDDR method that will be described later, and exists mainly in interstitial sites of the principal phase similarly with the N. The H contributes in improving the magnetic property such as the coercive force or the like. However, since too much replacement of the H decreases the improvement effect of the Curie temperature or the magnetocrystalline anisotropy of the principal phase, the replacement amount of the N by the H is preferable to be 50 atomic % or less. Further, a part of the N may be replaced by C or P. The replacement amount in this case is designated 50 atomic % or less of the N including the replacement amount of the H. A part of the N (50 atomic % or less) may be replaced by at least one kind element (X element) selected from H, C and P.

Incidentally, the magnetic material expressed by the aforementioned formula (1) allows to contain an avoidable impurity such as an oxide or the like.

The magnetic material of the present invention having the aforementioned composition includes 5 volume % or more of the $Th_2Ni_{17}$ type crystal phase, and has a fine crystal texture of an average grain diameter of in the range of from 0.02 to 50 μm. In particular, the magnetic material of the present invention is preferable to have the $Th_2Ni_{17}$ type crystal phase as the principal phase. Incidentally, the principal phase here indicates one that has the largest volume ratio among the constituent phases of the alloy. Such magnetic materials can be obtained, as will be described later, by implementing the HDDR treatment to the mother alloy of which principal phase is the $Th_2Ni_{17}$ type crystal phase.

The $Th_2Ni_{17}$ type crystal phase, compared with, for instance, the $TbCu_7$ type crystal phase, has a high coercive force. Further, the $Th_2Ni_{17}$ type crystal phase can include much more Fe or Co (T element) than the $Th_2Zn_{17}$ type crystal phase. For instance, when Sm and Fe are used as the $R^1$ and T elements, respectively, the $Th_2Zn_{17}$ type crystal phase has a small solid solution region. The Fe exceeding the stoichiometric ratio of 2:17 ($Sm_2Fe_{17}$ phase) precipitates as the α-Fe phase or the like. This deteriorates the magnetic property. On the other hand, the $Th_2Ni_{17}$ type crystal phase extends its solid solution region into Fe rich side, accordingly, even if there is a little more Fe than the stoichiometric ratio of 2:17, the $Th_2Ni_{17}$ type crystal phase can be formed. In concrete, even if the composition ratio is approximately $Sm2Fe_{17-19}$, the $Th_2Ni_{17}$ type crystal phase is formed. Thereby, in addition to an enhancement of the magnetic flux density, the crystal phase such as the α-Fe phase or the like that deteriorates the magnetic characteristics can be suppressed from precipitating.

The $Th_2Ni_{17}$ type crystal phase contributes greatly in enhancing the high performance of the magnetic material. From these, the magnetic material of the present invention includes at least 5% or more by volume ratio of the $Th_2Ni_{17}$ type crystal phase. When the volume ratio of the $Th_2Ni_{17}$ type crystal phase is less than 5% among the constituent phases of the magnetic material, an excellent magnetic characteristic can not be obtained. Further, in order to utilize fully the property that the $Th_2Ni_{17}$ type crystal phase possesses and to enhance higher performance of the magnetic material, the magnetic material of the present invention has the $Th_2Ni_{17}$ type crystal phase as the principal phase. In more concrete, it is preferable to include 50% or more by volume ratio of the $Th_2Ni_{17}$ type crystal phase. The $Th_2Ni_{17}$ type crystal phase is more preferable to be included 80% or more by volume ratio. Incidentally, the constituent phases of the magnetic material can be checked by use of X-ray diffraction or the like.

The magnetic material of the present invention includes at least 5% or more by volume ratio of the $Th_2Ni_{17}$ type crystal phase, furthermore has a fine recrystallization texture based on the HDDR treatment, that is, the recrystallization texture due to absorption and desorption of hydrogen. The recrystallization texture due to the absorption and desorption of the hydrogen is fine and excellent in homogeneity, and can give an average grain diameter in the range of from 0.02 to 50 μm. By reducing the average grain diameter of the magnetic material to 50 μm or less, the coercive force and the residual magnetization can be enhanced. The average grain diameter of the magnetic material of the present invention is more preferable to be 10 μm or less. However, when the average grain diameter is less than 0.02 μm, there occurs a disadvantage such as a difficulty in investment of the magnetism. The average grain diameter of the recrystallization texture is particularly preferable to be in the range of from 0.02 to 1 μm.

Measuring method of the average grain diameter of the principal phase of the present invention will be described below.

A transmission electron microphotograph of a metallic texture of a permanent magnet material is taken. When a cross section of a grain of $TbCu_7$ phase observed on the microphotograph is designated as $S_n$ ($\mu m^3$), the grain diameter $r_n$ (μm) is defined by the following equation.

$$r_n=2\times(\sqrt{S_n})/\pi$$

An average grain diameter t (μm) is an averaged value of the respective grain diameters $r_n$, that is, it is defined by the following equation.

$$t=(1/N)\times\Sigma r_n$$

Here, N is a number of measurement of grain diameter. In the present invention, the number of measurement N is preferable to be 60 or more.

The magnetic material containing at least 5% or more by volume ratio of the $Th_2Ni_{17}$ type crystal phase, furthermore, the magnetic material of which principal phase is the $Th_2Ni_{17}$ type crystal phase, as described above, has an excellent magnetic characteristics such as the high saturation magnetic flux density or the like. In addition, by making a fine crystal texture (recrystallization texture) of the average grain diameter in the range of from 0.02 to 50 μm, the coercive force, the residual magnetization or the like can be enhanced. Thus, the magnetic material of the present invention is to enhance furthermore the magnetic characteristics, therewith can cope with smaller size and higher performance of various kinds of electric component.

Now, the principal phase of the magnetic material of the present invention is not necessarily restricted to the $Th_2Ni_{17}$ type crystal phase. Depending on the compositions of the mother alloy thereon the HDDR treatment is carried out, the HDDR treatment condition, or the nitrogenization condition, the $Th_2Zn_{17}$, $TbCu_7$, or $ThMn_{12}$ type crystal phases can be the principal phase. Anyway, the $Th_2Ni_{17}$ type crystal phase is included at least 5% or more by volume ratio. When the amount of the $R^2$ element in the mother alloy is made relatively scarce, the $Th_2Zn_{17}$ type crystal phase tends to appear. Further, in the case of Ti being much among the $R^2$ elements or the M element that replaces a part of the T element being made much, the $TbCu_7$ or $ThMn_{12}$ type crystal phase tends to appear.

The principal phase of the magnetic material of the present invention can be selected according to usage. For instance, in the case of a high residual magnetization and maximum energy product being demanded, the $Th_2Ni_{17}$ type crystal phase is preferable to be the principal phase. For a magnetic material in which a high coercive force is asked for, the $Th_2Zn_{17}$ type crystal phase is preferable to be the principal phase. For a magnetic material in which a high thermal stability is asked for, the $TbCu_7$ or $ThMn_{12}$ type crystal phase can be made the principal phase. The principal phase here is one of the largest volume ratio among the constituent phases of the alloy, in concrete, is preferable to be 50% or more by volume ratio.

The volume occupancy of each phase existing in a magnetic material can be obtained from a transmission electron microphotograph of a cross section of the magnetic material by use of an areal analysis method.

With ratio of cross sections due to the areal analysis method, the volume occupancy can be expressed approximately. The volume occupancy of the present invention is an averaged values of 10 points.

The magnetic material of the present invention is manufactured, for instance, in the following manner.

First, an ingot including the prescribed amounts of the respective elements of $R^1$, $R^2$and T, further, as the need arises, B and M element, is prepared by an arc melting or a high-frequency melting. This mother alloy has the $Th_2Ni_{17}$ type crystal phase as a principal phase. To such an alloy ingot, as the need arises, in an inert gas atmosphere such as Ar, He or the like or in a vacuum, heat treatment is given under the conditions of the temperature in the range of approximately from 300 to 1200° C. and the time period in the range of from 0.1 to 200 hours. By implementing such a heat treatment, a mother alloy with less precipitation of an α-Fe phase is obtained.

The mother alloy that is used in preparation of the magnetic material of the present invention is preferable to have a composition expressed by the following general formula, $$\text{general formula: } (R^1{}_X R^2{}_{1-X})_Y B_{T1-Y-Z} \quad (2)$$

(where, $R^1$ is at least one kind of element selected from the rare earth elements, $R^2$ is at least one kind of element selected from Zr, Hf, Ti and Sc, T is at least one kind of element selected from Fe and Co, and X, Y, and Z designate numerical values satisfying $0.5 \leqq X < 1$, $0.05 \leqq Y \leqq 0.2$, and $0 \leqq Z \leqq 0.1$).

By satisfying such an alloy composition, the principal phase of the mother alloy can be easily made the $Th_2Ni_{17}$ type crystal phase. However, notwithstanding the same alloy composition, depending on the preparation conditions, the crystal phase can be different. Accordingly, by controlling the condition of implementation of the heat treatment or the like after the mother alloy is melted and forged, the principal phase of the mother alloy is made the $Th_2Ni_{17}$ type crystal phase.

Thereafter, the obtained mother alloy is pulverized to be an average particle diameter of approximately several tens μm to several hundreds μm by use of a ball mill, a brown mill, a stamping mill or the like. To such the mother alloy powder, the step of recrystallization due to absorption and desorption of hydrogen is carried out. That is to say, a HDDR (Hydrogenation-Disproportionation-Desorption-Recombination) treatment is given. The $Th_2Ni_{17}$ type crystal phase, as mentioned above, extends its solid solution region in an Fe rich side. Thereby, the phase that deteriorates the magnetic characteristics such as an α-Fe phase or the like can be suppressed from precipitating. As a result of this, after the HDDR treatment, the magnetic material that is scarce in the α-Fe phase or the like and excellent in performance can be prepared with reproducibility.

In the HDDR treatment, first, the powder of the mother alloy is heat treated at the temperature in the range of approximately from 650 to 800° C. in an atmosphere of a hydrogen gas for approximately from 30 min to 1 hour, to result in an absorption of hydrogen by the mother alloy. By this hydrogen absorption step, the $Th_2Ni_{17}$ type crystal phase decomposes into a $RH_X$ phase, an α-Fe phase or the like, and at the same time the crystal texture is made fine.

Next, while maintaining the same temperature, or while raising the temperature approximately from several tens to 100° C., the evacuation is carried out to dehydrogenate. Thereafter, it is cooled to the room temperature. By this dehydrogenation, a crystal phase including at least 5% by volume ratio or more of the $Th_2Ni_{17}$ type crystal phase is recrystallized. The crystal phase due to this recrystallization texture maintains the fine texture due to the absorption of hydrogen. Therefore, the fine crystal texture (recrystallization texture) of the average grain diameter in the range of 0.02 to 50 μm, further in the range of 0.02 to 1 μm can be obtained.

The constituent phases of the recrystallization texture are the $Th_2Ni_{17}$ type crystal phase, the $Th_2Zn_{17}$ type crystal phase, the $TbCu_7$ type crystal phase, the $ThMn_{12}$ type crystal phase or the like. The $Th_2Ni_{17}$ type crystal phase is included at least 5% by volume ratio or more. Though the principal phase of the recrystallized phase can be one of the aforementioned four kinds of the crystal phases, as mentioned above, to obtain the magnetic material of high saturation magnetic flux density or high performance, the $Th_2Ni_{17}$ type crystal phase is preferable to be the principal phase.

Thereafter, the alloy powder undergone the recrystallization due to absorption and desorption of the hydrogen is heat treated in an atmosphere containing nitrogen (nitrogenation), thereby the aimed powder like magnetic material can be obtained. Thus obtained magnetic material is isotropic magnetic particles. The nitrogenation is preferable to be carried out under the temperature condition of 400 to 500° C. in the atmosphere of nitrogen gas of the pressure of 0.01 to 10 atmosphere. The time period of the nitrogenation under these conditions is preferable to be 0.1 to 300 hours.

The atmosphere during the nitrogenation may be, in the place of the nitrogen gas, a nitrogen compound gas such as an ammonia gas or the like can be employed. When the ammonia gas is employed, the reaction rate of the nitrogenation can be enhanced. In this case, the simultaneous use of a gas such as hydrogen, nitrogen, Ar or the like can control the reaction rate of the nitrogenation.

In the aforementioned manufacturing method of the present invention, since the HDDR treatment is given to the mother alloy of which the principal phase is the $Th_2Ni_{17}$ type crystal phase, the magnetic material of high performance that has less α-Fe phase and a fine recrystallization texture can be obtained. Though the fine texture can be obtained also by a rapid cooling method, by omitting the rapid cooling step, manufacturing efficiency of the magnetic material can be improved and the manufacturing cost can be reduced. There is also such an advantage that the recrystallization texture of fine and homogeneous texture can be easily obtained. Further, the magnetic material having the fine $Th_2Ni_{17}$ type crystal phase as the principal phase can be obtained with reproducibility.

The magnetic material of the present invention is suitable for a constituent material of, for instance, a bonded magnet. In the following, a manufacturing method of a bonded magnet from the magnetic material of the present invention will be described. Incidentally, when a bonded magnet is prepared, normally, a magnetic material is pulverized. However, when the magnetic material has been pulverized in the aforementioned preparation step, this step can be omitted.

(a). The powder of the magnetic material of the present invention is mixed with an organic binder. The obtained mixture is molded into a desired shape by compression molding or injection molding to obtain a bonded magnet. As the binder, for instance, an epoxy based, a nylon-based resin or the like can be used. When a thermosetting resin such as the epoxy based resin is used as the binder, after molding into the desired shape, it is preferable to cure at the temperature of from 100 to 200° C. Incidentally, when a bonded magnet is prepared by the compression molding, by aligning crystal orientation under a magnetic field during pressurization, a permanent magnet of high magnetic flux density can be prepared.

(b). The powder of the magnetic material of the present invention, after being mixed with a low melt metal or a low melt alloy, is molded by the compression molding to prepare a metal bonded magnet. In this case, the low melt metal or the low melt alloy plays a role of the binder. As the low melt metal, for instance, Al, Pb, Sn, Zn, Cu, Mg or the like can be used, and as the low melt alloy, the alloys including the aforementioned low melt metals or the like can be used. In this case also, by aligning the crystal orientation under a magnetic field, a permanent magnet of high magnetic flux density can be prepared.

The specific embodiments of the present invention will be described below.

EMBODIMENT 1 to 8

First, the respective raw materials of high purity are compounded with the prescribed ratio and melted by high frequency melting in an Ar atmosphere to prepare the mother alloy ingots, respectively. Next, the respective ingots of the mother alloys are heat treated in a vacuum under a condition of 1100° C.×48 hours, and, thereafter, pulverized by a ball mill in the Ar atmosphere to be the average particle size of approximately 4 to 5 μm. Upon carrying out the X-ray diffraction of the respective mother alloys, all are confirmed to have the $Th_2Ni_{17}$ type crystal phase as the principal phase.

Next, the respective alloy powders are put in a heat treatment furnace and the furnace is evacuated to $1.5\times10^{-5}$ Torr. Thereafter, while flowing $H_2$ gas of 1 atmosphere into the furnace, the temperature is raised up to 730° C. and maintained there for 30 min. Then, being evacuated again, and, after the degree of vacuum reaches $1.5\times10^{-5}$ Torr, the temperature is raised again to 800° C. Thereafter, an Ar gas of 1 atmosphere is flowed into the furnace to cool rapidly the respective powders. By carrying out the X-ray diffraction of the respective obtained alloy powders, as a result of this, the respective powders are confirmed to have the $Th_2Ni_{17}$ type crystal phase as the principal phase.

Next, to make nitrogen included in the aforementioned respective alloy powders, the respective alloy powders are heat treated under a condition of 450° C.×25 hours in the nitrogen gas atmosphere of 1 atmosphere. By this nitrogenization, the respective materials increased their weights by 3.0 to 3.9%. The composition, principal phase and average grain diameter of the obtained magnetic materials are shown in Table 1.

Thus obtained respective magnetic materials, after being mixed with an epoxy resin of 2.5% by weight, are molded under the compression condition of 1200 MPa, further cured at a temperature of 150° C. for 2.5 hours to obtain the respective bonded magnets. The coercive force, residual magnetic flux density, and maximum magnetic energy product of the respective bonded magnets are shown in Table 1 as well.

COMPARATIVE EXAMPLE 1

An alloy ingot prepared with the identical manufacturing method as the aforementioned embodiments is pulverized to be an average particle diameter of approximately 4 to 5 μm. Upon carrying out the X-ray diffraction on the obtained alloy powder, it is confirmed that the $Th_2Ni_{17}$ type crystal phase is the principal phase.

Next, to the aforementioned alloy powder, without carrying out the heat treatment with the hydrogen, the nitrogenization treatment is carried out under the identical condition as that of the embodiments. With the obtained magnetic material, a bonded magnet is prepared as identical as the embodiments. The composition, principal phase and average grain diameter of the magnetic material, the coercive force, residual magnetic flux density and the maximum energy product of the bonded magnet are shown in Table 1 as well.

COMPARATIVE EXAMPLE 2

An alloy ingot prepared by the identical method as the embodiments is melted by high frequency induction heating in an Ar atmosphere, thereafter, the molten metal is sprayed from a nozzle on a metallic roll revolving with a peripheral speed of 40 m/s to quench, to prepare a thin ribbon. This quenched thin ribbon, after being heat treated in an Ar atmosphere under the condition of 750° C.×30 min, is pulverized to be an average particle diameter of approximately 4 to 5 μm. The X-ray diffraction of the obtained alloy powder was carried out to confirm $TbCu_7$ crystal phase to be the principal phase.

Next, the nitrogenation is carried out to the aforementioned alloy powder under the identical condition as the embodiments. With the obtained magnetic material, a bonded magnet is prepared as identical as the embodiments. The composition, principal phase and average grain diameter of the magnetic material, and the coercive force, residual magnetic flux density and maximum energy product of the bonded magnet are shown in Table 1 as well.

COMPARATIVE EXAMPLE 3

An alloy ingot prepared with the identical manufacturing method as the aforementioned embodiments is pulverized to be an average particle diameter of approximately 4 to 5 μm. Upon carrying out the X-ray diffraction on the obtained alloy powder, it is confirmed that the $Th_2Zn_{17}$ type crystal phase is the principal phase.

Next, to the aforementioned alloy powder, the heat treatment with the hydrogen and the nitrogenation treatment is carried out under the identical condition as that of the embodiments. With the obtained magnetic material, a bonded magnet is prepared as identical as the embodiments. The principal phase of the magnetic material of this comparative example 3 is the $Th_2Zn_{17}$ type crystal phase. The volume percentage of the $Th_2Ni_{17}$ type crystal phase was 3%. The composition, principal phase and average grain diameter of the magnetic material, the coercive force, residual magnetic flux density and the maximum energy product of the bonded magnet are shown in Table 1 as well.

TABLE 1

| | Magnetic material | | | | | | | | | | Residual | The |
|---|---|---|---|---|---|---|---|---|---|---|---|---|
| | Material | | | | | | | Principal | Average grain diameter | Coercive force | magnetic flux density | maximum energy product |
| | R1 | R2 | T (contains M) | X | Y | Z | Q | phase | (μm) | (kA/m) | (T) | (kJ/m³) |
| | | | | | Embodiment | | | | | | | |
| 1 | $Sm_{0.98}Gd_{0.02}$ | $Zr_{1.00}$ | $Co_{0.04}Nb_{0.01}Fe_{0.95}$ | 0.77 | 0.12 | 0 | 0.16 | $Th_2Ni_{17}$ | 0.52 | 2088 | 0.61 | 56 |
| 2 | $Sm_{0.89}Nd_{0.11}$ | $Zr_{0.93}Hf_{0.07}$ | $Co_{0.08}Fe_{0.92}$ | 0.83 | 0.13 | 0 | 0.14 | $Th_2Ni_{17}$ | 0.18 | 1875 | 0.63 | 54 |
| 3 | $Sm_{0.91}Pr_{0.09}$ | $Zr_{0.95}Hf_{0.05}$ | $Co_{0.05}Si_{0.03}$ $Al_{0.01}Fe_{0.91}$ | 0.75 | 0.12 | 0 | 0.15 | $Th_2Ni_{17}$ | 0.12 | 1902 | 0.61 | 53 |

TABLE 1-continued

| | Magnetic material | | | | | | | | | | Residual | The |
|---|---|---|---|---|---|---|---|---|---|---|---|---|
| | Material | | | | | | | Principal | Average grain diameter | Coercive force | magnetic flux density | maximum energy product |
| | R1 | R2 | T (contains M) | X | Y | Z | Q | phase | (μm) | (kA/m) | (T) | (kJ/m³) |
| 4 | $Sm_{0.97}Ce_{0.03}$ | $Zr_{0.92}Hf_{0.08}$ | $Co_{0.12}Ga_{0.01}Cr_{0.05}Fe_{0.82}$ | 0.74 | 0.14 | 0 | 0.15 | $Th_2Ni_{17}$ | 0.32 | 2007 | 0.60 | 59 |
| 5 | $Sm_{0.91}Nd_{0.05}Ce_{0.04}$ | $Zr_{1.00}$ | $Co_{0.06}Al_{0.06}Ta_{0.02}Fe_{0.86}$ | 0.81 | 0.13 | 0 | 0.16 | $Th_2Ni_{17}$ | 0.20 | 1630 | 0.63 | 58 |
| 6 | $Sm_{0.98}Gd_{0.02}$ | $Zr_{1.00}$ | $Co_{0.04}Nb_{0.01}Fe_{0.95}$ | 0.77 | 0.12 | 0.012 | 0.16 | $Th_2Ni_{17}$ | 0.20 | 2100 | 0.65 | 62 |
| 7 | $Sm_{0.89}Nd_{0.11}$ | $Zr_{0.93}Hf_{0.07}$ | $Co_{0.08}Fe_{0.92}$ | 0.83 | 0.13 | 0.015 | 0.14 | $Th_2Ni_{17}$ | 0.12 | 1880 | 0.68 | 62 |
| 8 | $Sm_{0.91}Pr_{0.09}$ | $Zr_{0.95}Hf_{0.05}$ | $Co_{0.05}Si_{0.03}Al_{0.01}Fe_{0.91}$ | 0.75 | 0.12 | 0.022 | 0.15 | $Th_2Ni_{17}$ | 0.10 | 1910 | 0.65 | 60 |
| | | | | | Comparative example | | | | | | | |
| 1 | $Sm_{0.98}Gd_{0.02}$ | $Zr_{1.00}$ | $Co_{0.04}Nb_{0.01}Fe_{0.95}$ | 0.77 | 0.12 | 0 | 0.16 | $Th_2Ni_{17}$ | 75 | 825 | 0.59 | 43 |
| 2 | $Sm_{0.98}Gd_{0.02}$ | $Zr_{1.00}$ | $Co_{0.04}Nb_{0.01}Ge_{0.95}$ | 0.77 | 0.12 | 0 | 0.16 | $TbCu_7$ | 0.05 | 685 | 0.63 | 56 |
| 3 | $Sm_{0.65}Nd_{0.35}$ | $Zr_{1.00}$ | $Co_{0.07}Fe_{0.93}$ | 0.97 | 0.12 | 0.01 | 0.15 | $Th_2Zn_{17}$ * | 0.25 | 755 | 0.58 | 45 |

*: The volume percentage of the $Th_2Ni_{17}$ crystal phase is 3%.

As evident from the table 1, the bonded magnets according to the respective embodiments are superior in the coercive force and residual magnetic flux density to the bonded magnet of comparative example 1 in which the heat treatment with hydrogen was not given, further the bonded magnet of comparative example 3 in which the HDDR treatment was given to an alloy of which principal phase is the $Th_2Zn_{17}$ crystal phase. In particular, the coercive force is increased to approximately two to three times. Further, since the bonded magnets according to the embodiments 6 to 8 that include a trace of B are excellent in homogeneity of the texture, the residual magnetization is large, accordingly, the larger maximum energy product can be obtained. The bonded magnet of the comparative example 2 that is manufactured by the super-rapid cooling method and has the TbCu, type crystal phase as the principal phase, though comparable with embodiments 1 to 5 from the maximum energy product point of view, is smaller in its coercive force by approximately 30 to 40% than that of the embodiments 1 to 5.

EMBODIMENTS 9 to 13

The respective raw materials of high purity are compounded with the prescribed ratio and melted by high frequency melting in an Ar atmosphere to prepare mother alloy ingots, respectively. Next, the respective ingots of the mother alloys are heat treated in a vacuum under a condition of 1100° C.×48 hours, thereafter, pulverized by a ball mill in the Ar atmosphere to be the average particle diameter of approximately 4 to 5 μm. Upon carrying out the X-ray diffraction of the respective mother alloys, all are confirmed to have the $Th_2Ni_{17}$ type crystal phase as the principal phase.

Next, the respective alloy powders are put into a heat treatment furnace and the furnace is evacuated to $1.5\times10^{-5}$ Torr. Thereafter, while flowing $H_2$ gas of 1 atmosphere into the furnace, the temperature is raised up to 730° C. and maintained there for 30 min. Then, being evacuated again, and, after the degree of vacuum reaches $1.5\times10^{-5}$ Torr, the temperature is raised again to 800° C. Thereafter, an Ar gas of 1 atmosphere is flowed into the furnace to cool rapidly the respective powders. By carrying out the X-ray diffraction of the respective obtained alloy powders, the principal phase and the volume percentage of the $Th_2Ni_{17}$ type crystal phase are obtained.

Next, to make nitrogen included in the aforementioned respective alloy powders, the respective alloy powders are heat treated under a condition of 450° C.×25 hours in the nitrogen gas atmosphere of 1 atmosphere. By this nitrogenization, the respective materials increased their weights by 3.0 to 3.9%. The composition, principal phase, the volume percentage of the $Th_2Ni_{17}$ type crystal phase and average grain diameter of the obtained magnetic materials are shown in Table 2.

Thus obtained respective magnetic materials, after being mixed with an epoxy resin of 2.5% by weight, are molded under the compression condition of 1200 MPa, further cured at a temperature of 150° C. for 2.5 hours to obtain the respective bonded magnets. The coercive force, residual magnetic flux density, and maximum magnetic energy product of the respective bonded magnets are shown in Table 2 as well.

TABLE 2

| | Magnetic material | | | | | | | | | | | | |
|---|---|---|---|---|---|---|---|---|---|---|---|---|---|
| | Material composition | | | | | | | Principal | Volume percentage of $Th_2Ni_{17}$ phase | Average grain diameter | Coercive force | Residual magnetic flux density | The maximum energy product |
| | R1 | R2 | T (contains M) | X | Y | Z | Q | phase | (%) | (μm) | (kA/m) | (T) | (kJ/m³) |
| 9 | $Sm_{1.00}$ | $Zr_{1.00}$ | $Co_{0.05}Fe_{0.95}$ | 0.79 | 0.12 | 0.01 | 0.15 | $Th_2Ni_{17}$ | 88 | 0.09 | 1450 | 0.61 | 60 |
| 10 | $Sm_{1.00}$ | $Zr_{0.98}Ti_{0.02}$ | $Co_{0.03}Fe_{0.97}$ | 0.98 | 0.11 | 0.01 | 0.16 | $Th_2Zn_{17}$ | 42 | 0.25 | 1150 | 0.63 | 60 |
| 11 | $Sm_{0.95}Nd_{0.05}$ | $Zr_{1.00}$ | $Co_{0.08}Nb_{0.02}Fe_{0.90}$ | 0.95 | 0.12 | 0.02 | 0.14 | $TbCu_7$ | 12 | 0.15 | 1025 | 0.62 | 58 |
| 12 | $Sm_{0.92}Ce_{0.08}$ | $Zr_{0.97}Hf_{0.08}$ | $Co_{0.04}Fe_{0.96}$ | 0.88 | 0.13 | 0.01 | 0.15 | $Th_2Zn_{17}$ | 35 | 0.22 | 1450 | 0.60 | 62 |
| 13 | $Sm_{0.98}Pr_{0.02}$ | $Zr_{0.95}Ti_{0.05}$ | $Co_{0.03}Fe_{0.97}$ | 0.73 | 0.12 | 0.01 | 0.15 | $Th_2Zn_{17}$ | 40 | 0.35 | 1230 | 0.64 | 65 |

As obvious from the table 2, by adjusting the composition of the mother alloys, the magnetic materials in which various kinds of crystal phases can be the principal phase can be obtained. Further, the magnetic material of which principal phase is any crystal phase has excellent magnetic characteristics.

As evident from the aforementioned embodiments, in the present invention, a mother alloy of which principal phase is the $Th_2Ni_{17}$ crystal phase is exposed to the HDDR treatment. Thereby, the metallic texture of the magnetic material that includes the $Th_2Ni_{17}$ crystal phase as the indispensable component is made a fine recrystallization texture. Accordingly, the magnetic materials of excellent magnetic characteristics can be provided. By employing such magnetic materials, the bonded magnets of higher performance can be obtained.

What is claimed is:

1. A magnetic material consisting essentially of a composition expressed by the following general formula, $$\text{general formula: } \{R^1{}_X R^2{}_{1-X})_Y B_Z T_{1-Y-Z}\}_{1-Q} N_Q$$

(where, $R^1$ is at least one kind of element selected from rate earth elements, $R^2$ is at least one kind of element selected from Zr, Hf, Ti and Sc, T is at least one kind of element selected from Fe and Co, and X, Y, Z and Q designate numerical values satisfying $0.5 \leqq X < 1$, $0.05 \leqq Y \leqq 0.2$, $0 \leqq Z \leqq 0.1$ and $0.1 < Q \leqq 0.2$); and including 5 volume % or more of a $Th_2Ni_{17}$ crystal phase;

wherein the average grain diameter of the magnetic material is in the range of from 0.02 to 50 μm.

2. The magnetic material as set forth in claim 1:

wherein the magnetic material has a recrystallization texture due to absorption and desorption of hydrogen.

3. The magnetic material as set forth in claim 1:

wherein the magnetic material has a recrystallization texture obtained by recrystallization of a mother alloy due to absorption and desorption of hydrogen, and the mother alloy having the $Th_2Ni_{17}$ crystal phase as a principal phase.

4. The magnetic material as set forth in claim 1:

wherein the magnetic material has a recrystallization texture of which average grain diameter is in the range of from 0.02 to 1 μm.

5. The magnetic material as set forth in claim 1:

wherein the magnetic material includes 50 volume % or more of the $Th_2Ni_{17}$ crystal phase.

6. The magnetic material as set forth in claim 1:

wherein the $Th_2Ni_{17}$ crystal phase, a $Th_2Zn_{17}$ crystal phase, a $TbCu_7$ crystal phase or a $ThMn_{12}$ crystal phase is the principal phase.

7. The magnetic material as set forth in claim 1:

wherein Z expressing a content of the B satisfies $0.005 \leqq Z \leqq 0.1$.

8. The magnetic material as set forth in claim 1:

wherein Z expressing a content of the B satisfies $0.005 \leqq Z \leqq 0.05$.

9. The magnetic material as set forth in claim 1:

wherein 50 atomic % or more of the $R^1$ element is Sm.

10. The magnetic material as set forth in claim 1:

wherein 50 atomic % or more of the T element is Fe.

11. The magnetic material as set forth in claim 1, further comprising:

at least one kind of M element selected from V, Cr, Mo, W, Mn, Ga, Al, Sn, Ta, Nb, Si and Ni;

wherein 20 atomic % or less of the T element is replaced by the M element.

12. The magnetic material as set forth in claim 1, further comprising:

at least one kind of X element selected from H, C and P;

wherein 50 atomic % or less of the M element is replaced by the X element.

13. A bonded magnet, comprises:

a mixture of a magnetic material as set forth in claim 1 and a binder;

wherein the mixture has a molded body of a magnet shape.

* * * * *

UNITED STATES PATENT AND TRADEMARK OFFICE

CERTIFICATE OF CORRECTION

PATENT NO. : 6,290,782 B1 
DATED : September 18, 2001
INVENTOR(S) : Shinya Sakurada et al.

It is certified that error appears in the above-identified patent and that said Letters Patent is hereby corrected as shown below:

Column 1,
Line 43, insert comma after parenthesis

Column 3,
Line 14, delete "$B_{zT1}$", replace with -- $B_zT_1$ --
Line 59, delete "$0.05 \leqq Y < 0.2$,", replace with -- $0.05 \leqq Y \leqq 0.2$, --

Column 4,
Line 9, delete "$_{Y-\}}$", replace with -- Y-Z} --
Line 53, delete "t he", replace with -- the --
Line 53, delete "for mula", replace with -- formula --

Column 5,
Line 4, delete "rang e", replace with -- range --

Column 8,
Line 51, delete "$B_{T1}$", replace with -- $B_zT_1$ --

Column 9,
Lines 19, 27 and 57, delete "C.", replace with -- C --

Column 10,
Line 61, delete "1100º C.x48 hours", replace with -- 1100º C x 48 hours --

Column 11,
Line 16, delete "450º C.x25 hours", replace with -- 450º C x 25 hours --

Column 12,
Line 12, delete "750º C.x30 hours", replace with -- 750º C x 30 hours --
TABLE 1, delete "Material", replace with -- Material Composition --
TABLE 1 (continued), delete "Material", replace with -- Material Composition --

Column 13,
Line 64, delete "1100º C.x48 hours", replace with -- 1100º C x 48 hours --

Column 14,
Line 48, delete "450º C.x25 hours", replace with -- 450º C x 25 hours --

UNITED STATES PATENT AND TRADEMARK OFFICE

CERTIFICATE OF CORRECTION

PATENT NO. : 6,290,782 B1
DATED : September 18, 2001
INVENTOR(S) : Shinya Sakurada et al.

It is certified that error appears in the above-identified patent and that said Letters Patent is hereby corrected as shown below:

Column 15,
Line 43, delete "rate", replace with -- rare --
Line 48, delete "$0 \leq Z \leq 0.1$", replace with -- $0 < Z \leq 0.1$ --
Line 48, delete "$0.1 < Q \leq 0.2$", replace with -- $0.1 \leq Q \leq 0.2$ --

Column 16,
Line 53, delete "M", replace with -- N --

Signed and Sealed this

Eighteenth Day of February, 2003

JAMES E. ROGAN
*Director of the United States Patent and Trademark Office*